US005287925A

United States Patent [19]

Watkins et al.

[11] Patent Number: 5,287,925

[45] Date of Patent: Feb. 22, 1994

[54] WELLHEAD APPARATUS

[75] Inventors: Bruce J. Watkins; Blake T. DeBerry, both of Houston, Tex.

[73] Assignee: Dril-Quip, Inc., Houston, Tex.

[21] Appl. No.: 26,475

[22] Filed: Mar. 4, 1993

[51] Int. Cl.[5] ..... E21B 23/00

[52] U.S. Cl. ..... 166/208

[58] Field of Search ..... 166/208, 217, 206, 181, 166/182, 123-125, 382-387

[56] References Cited

U.S. PATENT DOCUMENTS 4,757,860 7/1988 Reimert .

5,074,362 12/1991 Allwin ..... 166/208 X 5,086,845 2/1992 Baugh ..... 166/208 X 5,092,401 3/1992 Heynen ..... 166/208 X

*Primary Examiner*—Thuy M. Bui

*Attorney, Agent, or Firm*—Vaden, Eickenroht, Thompson, Boulware & Feather

[57] ABSTRACT

There is disclosed wellhead apparatus in which a pipe string is suspended within the bore of a housing and the annular space between the bore and the outer wall of the pipe string or a mandrel-type hanger from which the pipe string is suspended is closed by a seal assembly. The seal assembly is lowered into the annular space on a tool so as to close the same as seal rings carried about the outer and inner sides of the body are energized into sealing engagement with the bore of the housing and the outer wall.

11 Claims, 6 Drawing Sheets

WELLHEAD APPARATUS

This invention relates generally to wellhead apparatus in which a pipe string is suspended within the bore of a housing and the annular space between the bore and the outer wall of the pipe or a mandrel-type hanger from which the pipe string is suspended is closed by a seal assembly. More particularly, it relates to improvements in apparatus of this type in which the annular space is sealed off by a seal assembly which is lowered into the space from the upper end of the housing after the pipe string is suspended.

Pipe strings may be supported from the bore of the wellhead housing by means on mandrel-type hangers connected to their upper ends and lowered with a suitable running tool into landed position in the bore. The annular space between the mandrel and bore is then closed by a seal assembly which may be lowered with the mandrel in a raised position and then lowered into sealing engagement with the mandrel and bore. As shown in U.S. Pat. No. 4,757,860, assigned to the assignee of the present application, the seal assembly may be of a configuration to permit it to be wedged into metal-to-metal sealing engagement with the bore and a conically shaped outer wall of the hanger. Alternatively, the seal assembly may be lowered separately into the annular space and then caused to seal with respect to the bore and outer wall of the mandrel.

Due to emergency situations, such as a stuck pipe, it might not be possible to lower the pipe string to full depth. In this case, flanges at adjacent sections of the housing must be disconnected intermediate its upper and lower ends to permit a slip assembly to be lowered through the annular space between the housing and pipe string into a position to grip the string below its upper end. A portion of the string above the slips is then cut away and a seal assembly installed above the slips to seal between the cut pipe string and bore, and the adjacent housing sections then reconnected.

Wellhead apparatus installed on many wells have so-called "unitized" housings mounted substantial distances below the rig floor, whereby it would be time-consuming and dangerous to obtain access to its bore in the manner described. Also, disconnecting portions of the wellhead above the housing might be a violation of Government regulations. Consequently, in this case, the seal assembly must instead be lowered a substantial distance into the housing and then caused to seal with respect to both the bore and outer wall of the mandrel-type hanger or pipe string above the slip assembly.

Seal assemblies for sealing between the cylindrical outer wall of a cut pipe string and the housing bore conventionally comprise a seal ring of elastomeric material sandwiched between annular metal plates to permit the seal ring to be expanded into sealing engagement with the bore and outer wall. Ordinarily, this is accomplished by lock screws mounted on the housing for movement radially inwardly to engage and force the metal plate toward one another. However, many operators find the use of lock screws unacceptable since they require multiple penetrations of the wellhead housing which are potential leak sources.

Also, with seal assemblies of this type, the load of additional equipment lowered into and landed in the bore above the assembly is transmitted directly to the seal ring, thereby often overloading it to the point of causing damage. Still further, as the additional equipment is installed, there is no way to obtain access to the seal assembly in the event it must be reenergized for any reason or in the event it is necessary to test the seals, other than through elaborate and complicated arrangements of fluid lines extending downwardly with a running tool from the upper end of the housing.

It would therefore be desirable and a primary object of this invention to provide such wellhead apparatus having a seal assembly which may be installed from above the housing and whose seal rings may be energized or reenergized from an external source at a remote location and thus whether or not other equipment is installed above the seal assembly.

Another object is to provide apparatus having such a seal assembly whose seal rings may be tested with test pressure from a remote location, such as above the housing bore.

A further object is to provide such apparatus in which the seal assembly is of such construction that the load of additional equipment landed above it is not transmitted to the seal rings.

These and other objects are accomplished in accordance with the preferred embodiment of this invention by wellhead apparatus including a housing having a port opening to its bore and valve means in the port permitting flow only toward the bore, a seal assembly for closing the annular space between the bore and an outer wall of either the suspended pipe string or a mandrel-type hanger by which it is suspended, and a tool for lowering the assembly through the space. In accordance with one novel aspect of the invention, the assembly includes an annular body for landing in the bore, upper and lower first and second seal rings carried about the outer side of the body for sealing with the bore above the below the opening of the port thereto, and a third seal ring carried on the inner side of the body for sealing with the outer wall. More particularly, the assembly further includes a means on the body which is responsive to vertical movement with respect to the body for energizing the first and second seal rings into sealing engagement with the bore, together with means which includes passageway means in the body connecting with the port, so that, when the first and second seal rings are energized, a medium such as plastic packing may be supplied through the port and passageway means to the third seal ring in order to energize it into sealing engagement with the wall.

Preferably, the passageway means also includes means for supplying the medium to the first and second seal rings to further expand them into sealing engagement with the bore. Thus, the first and second seal ring as well as the third seal ring may be reenergized by the supply thereto of the medium from a source external at the wellhead to the housing.

In the preferred and illustrated embodiment of the invention, the first and second seal rings are separated by a rigid spacer ring carried about the body intermediate the first and second seal rings and having passageway means connecting the port and passageway means in the body, and the means for energizing the first and second seal rings comprises means on the body which is responsive to vertical movement with respect to the body for expanding the first and second seal rings into sealing engagement with the bore, and means on the body releasably connectible to the tool and responsive to actuation of the tool for so moving the expanding means and then locking said expanding means against movement in the opposite vertical direction in order to hold the first and second seal rings in sealing engagement with the bore.

The expanding means comprises a ring surrounding the body above the first seal ring, and the moving and locking means comprises locking means supported by the expanding ring for movement downwardly and outwardly into locking engagement with the bore, and means connected to the body for forcing said locking means downwardly and outwardly in response to actuation of the tool. More particularly, the expanding ring is lowered into engagement with the body and the locking and forcing means are lowered into engagement with the expanding ring whereby the load of equipment lowered onto the assembly, following disconnection and removal of the tool therefrom, is transmitted to the body and thus not through the first and second seal rings. As also illustrated, in the preferred embodiment of the invention, the forcing means includes a nut threadedly connected to the body, and the tool is releasably connected to the nut for transmitting rotation thereto in order to lower the nut in response to rotation of the tool.

In accordance with further novel aspects of the invention, a fourth seal ring is carried on the inner side of the body for sealing with the wall below the third seal ring, and the passageway means in the body includes means through which the medium may also be supplied to the fourth seal ring in order to energize it into sealing engagement with the wall. More particularly, the assembly further includes a fifth seal ring carried about the outer side of the body below the second seal ring, the passageway means in the body includes means through which the medium may be supplied to the fifth ring to energize it into sealing engagement with the bore, the housing also has a second port opening to the bore intermediate the second seal ring and the fifth seal ring and valve means in the second port permitting flow only toward the bore, and the body has second passageway means therein connecting its outer side intermediate the second and fifth seal rings with the inner side of the body intermediate the third and fourth seal rings, whereby fluid may be introduced through the second port to test the third and fourth seal rings.

In the drawings, wherein like reference characters are used throughout to designate like parts:

FIG. 1 is a half vertical sectional view of wellhead apparatus constructed in accordance with the present invention, including a slip assembly landed in the bore of the housing to suspend a pipe string therefrom, and the seal assembly lowered on a tool into a landed position in the annular space between an upper cut end of the pipe string and the bore of the housing above the slip assembly;

FIG 2 is a view similar to FIG. 1, but upon rotation of the tool to lower the locking and expanding means of the seal assembly in order to expand first and second seal rings into sealing engagement between the outer side of the body and the bore of the housing, and further showing third and fourth seal rings about the inner side of the body as well as a fifth seal ring about the outer side of the body below the second seal ring energized into sealing engagement with the outer diameter of the pipe string and housing bore responsive to the supply of plastic packing thereto through passageway means connecting with a valve-controlled port in the housing intermediate the expanded first and second seal rings;

Figure 9:
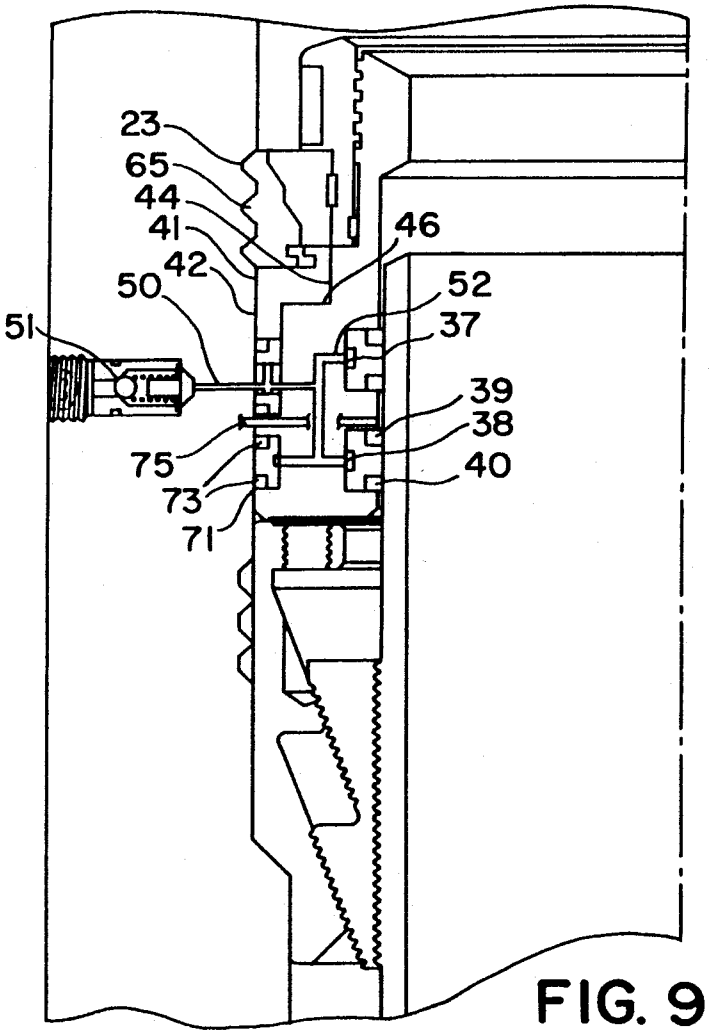
Figure 8:
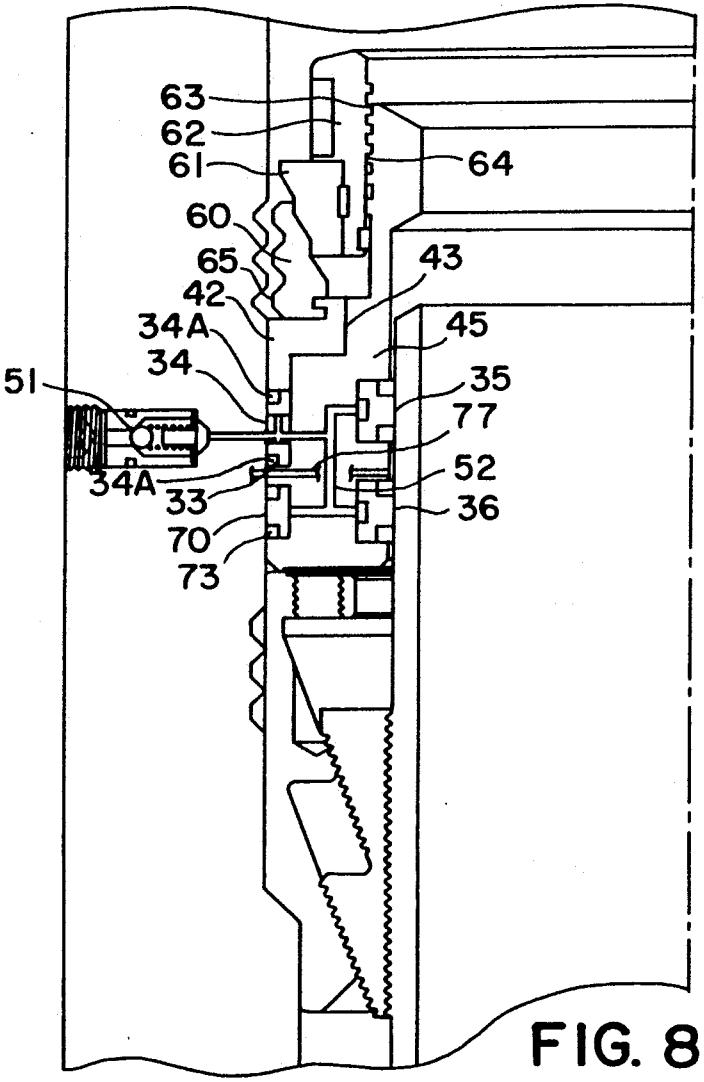
FIG. 8 is an enlarged cross-sectional view of a portion of the housing and seal assembly upon lowering the seal assembly onto the slip assembly, as shown in FIG. 1, but also showing the relationship of the passageway means for test fluid with respect to the passageway means for the plastic packing.
Figure 10:
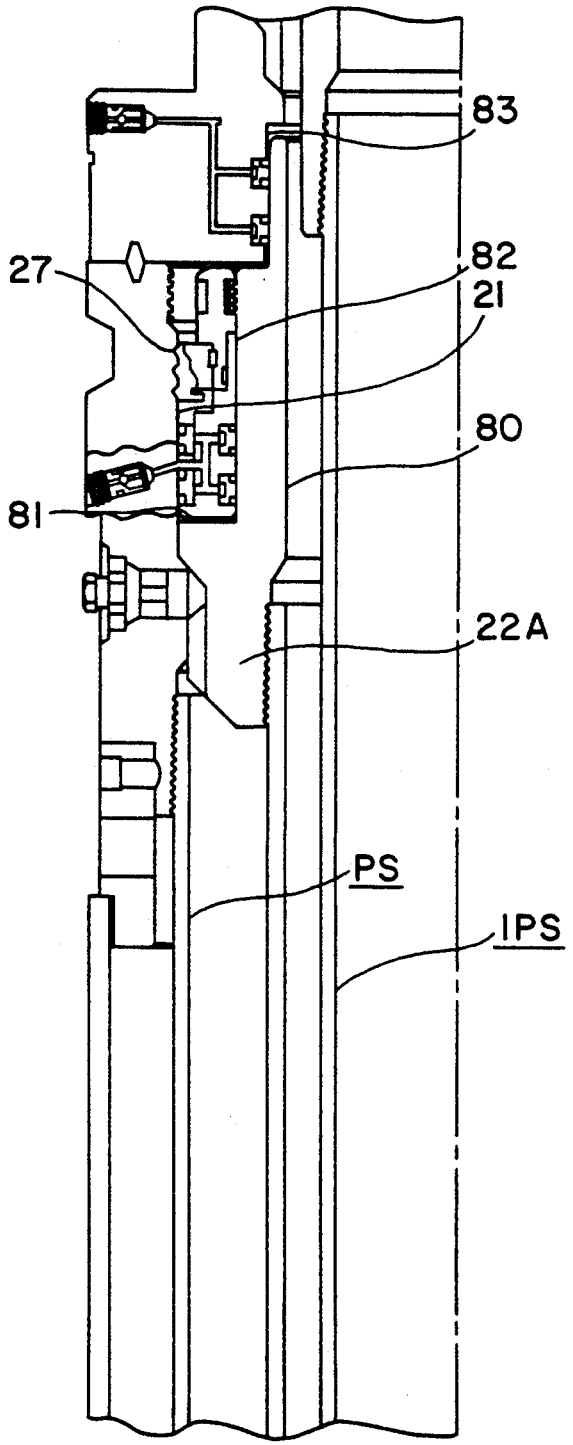

FIG. 9 is a view similar to FIG. 8, upon lowering the locking means and the expanding means to lock the first and second seal rings in sealing engagement with the housing bore and the introduction of plastic packing to the third, fourth and fifth seal rings for energizing them into sealing engagement with the pipe string and housing bore; and FIG. 10 is a half vertical sectional view of an alternative form of wellhead apparatus, wherein the seal assembly is lowered into and locked down in a landed position within an annular space between the housing bore and the outer wall of a mandrel-type hanger from which the pipe string is suspended.

With reference now to the details of the above described drawings, the wellhead apparatus is shown in FIGS. 1-5 to include a housing 20 at the head of the well having a bore 21, an upwardly facing seat 22 in the bore, and grooves 23 about the bore above the seat. A pipe string PS is shown to be suspended from a hanger assembly landed on the seat in the bore of the housing to define an annular space between it and the upper cut end of the pipe string above the hanger assembly. As more particularly shown and described in co-pending application Ser. No. 08/007,334 (DRIA,038), assigned to the assignee of the present application, the hanger assembly is shown to include a slip bowl 24 having a shoulder 26 landed on the seat 22 and a circumferentially split slip assembly 25 within the bowl for sliding downwardly and inwardly therealong, so as to permit the teeth thereon to engage the pipe string whereby the weight of the pipe string may be lowered onto the slip assembly. As previously indicated, and as to be described in connection with the wellhead apparatus of FIG. 10, this invention contemplates that the pipe string may instead be suspended by other means, such as a mandrel-type hanger connected to the upper end of the pipe string and landed on the seat 22, in which case the outer wall of the mandrel defines an annular space between it and the bore of the housing.

Figure 1:
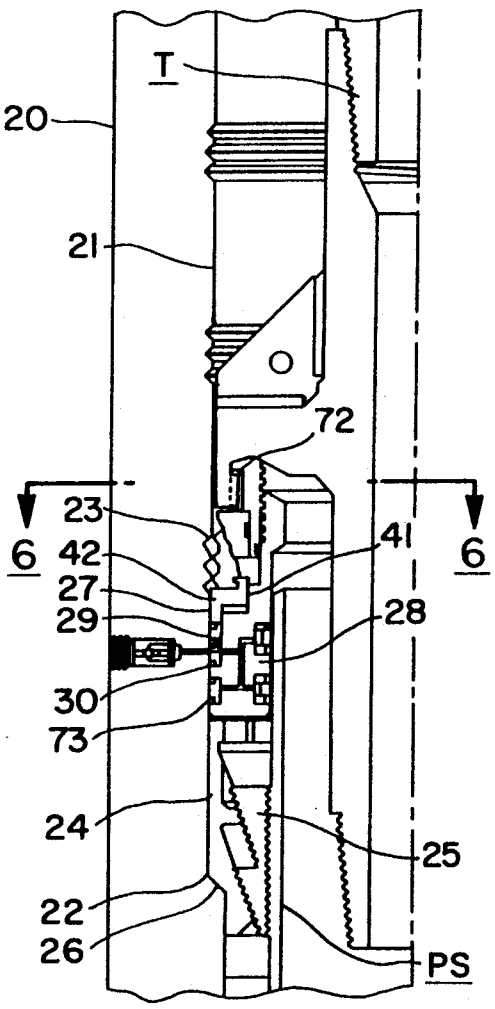

The seal assembly constructed in accordance with the present invention, and indicated in its entirety our reference character 27, has been shown in FIG. 1 to have been lowered by the tool T into a landed position on the upper end of the slip assembly. As previously described, the seal assembly includes a metal body 28 which is lowered onto the hanger assembly, and upper and lower first and second seal rings 29 and 30 carried about the reduced diameter outer wall 32 of the body 28 and supported on an upwardly facing shoulder 33 at its lower end of the wall. More particularly, the first and second seal rings 29 and 30 are separated by a metal spacer ring 34 which, like the seal rings, fits closely between the outer wall 32 of the body. In order to facilitate lowering of the assembly into the space, the seal rings are spaced from the bore of the housing or form only an interference seal therewith not intended to contain high pressures.

The seal rings comprise an annular body of elastomeric material having a split ring 34A in one corner thereof, and particularly in the upper left hand corner of first seal ring 29 and the lower left hand corner of the second seal ring 30. As well known in the art, these rings are adapted to be circumferentially expanded with the elastomeric body to bear tightly against the bore of the housing and thus prevent extrusion of the elastomeric body therepast.

The seal assembly also includes third and fourth seal rings 35 and 36 about the inner side of the body of the seal assembly for sealing with respect to the upstanding end of the pipe string PS. More particularly, each of the seal rings 35 and 36 comprises a body of elastomeric material received within vertically spaced grooves 37 and 38 in the inner side of the body, and split, anti-extrusion metal rings 39 and 40 in the outer corners of the elastomeric body. As in the case of the first and second seal rings, the seal rings 35 and 36 are either spaced from or only lightly engaged with the pipe string as the body is lowered into the annular space.

The seal assembly further includes an expanding ring 41 having an outer, downwardly extending flange 42 disposed about a wall 32 of the body above the first seal rings 29 and an inwardly extending flange 43 which fits closely about an intermediate vertical wall 44 of the body above an upwardly facing shoulder 45 of the body. As the seal assembly is first lowered onto the hanger, the expanding ring 41 occupies the upper position shown in FIG. 1 wherein the lower end of its inner flange is above the upwardly facing seat 45 of the body. In this raised position then, the lower end of the ring 41 has not imparted downward force to the first and second seal rings, such that the outer sides of the first and second seal rings as well as the third and fourth seal rings move freely downwardly into the annular space.

Figure 3:
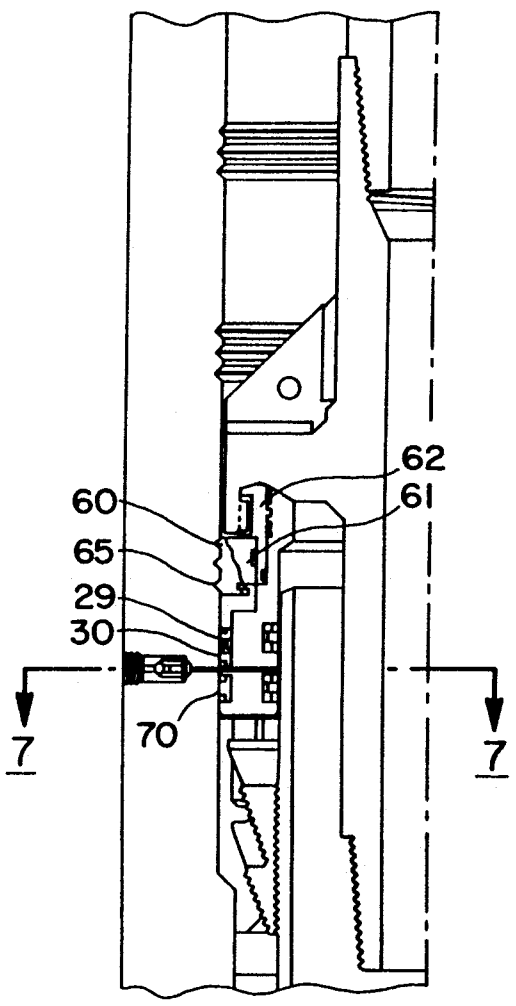
FIG. 3 is another view similar to FIG. 2, but showing another valve-controlled port in the housing connecting its bore with additional passageway means in the body intermediate the second seal ring and the fifth seal ring in order to permit test fluid to be introduced intermediate the third and fourth seal rings.
Figure 2:
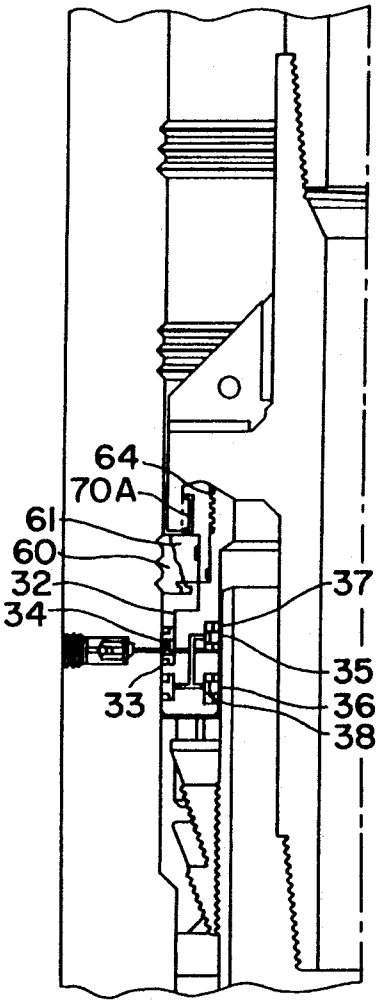

However, upon lowering of the expanding ring into the position of FIGS. 2 and 8, the first seal ring and thus the spacer ring are lowered to cause the first and second seal rings to expand outwardly and thus be energized into sealing engagement with the bore of the housing, the split rings moving outwardly with the elastomeric body of each seal ring to serve their anti-extrusion functions. As will be described in detail to follow, this lowering of the expanding ring to expand the first an second seal rings is responsive to actuation of the tool T on which the assembly has been lowered into landed position.

As previously described, upon energizing of the first and second seal rings, the third and fourth seal rings may be energized into sealing engagement with the pipe string by means external to the housing. For this purpose, a port 50 formed in the housing and having a one-way check valve 51 installed therein connects with the bore of the housing intermediate the first and second seal rings. As also previously described, a passageway means 52 is formed in the spacer ring and the body to connect with the outer side of the seal assembly intermediate the first and second seal rings. Thus, with the check valve 51 arranged to permit flow only toward the bore of the housing, plastic packing or other energizing medium may be supplied from a remote source, such as through a line extending downwardly from the upper end of the housing bore, and through the port 50 and passageway means 52 into recesses formed in the outer sides of the third and fourth seal rings. This, of course, will energize the third and fourth seal rings by causing them to move inwardly against the pipe string. At the same time, the metal anti-extrusion rings are moved with the elastomeric body into engagement with the pipe string at the upper and lower inner corners of the seal rings.

As previously described, the means by which the expanding ring 42 is moved downwardly to expanding position and locked in that position includes a split ring 60 supported on the expanding ring and initially connected thereto by a tongue and groove arrangement which permits relative movement of the split ring with respect to the expanding ring, but prevents vertical movement between them. As also previously described, the seal assembly also further includes a wedge ring 61 which is disposed about the inner side of the split ring 60 and so formed as to cause the split ring to expand outwardly in response to lowering of the wedge ring with respect to the split ring. This lowering of the wedge ring is in turn caused by lowering of a nut 62 having its lower end disposed within and bearing upon the wedge ring and threads 63 about its inner side threadably engaged with threads 64 about the tool T.

The split ring is supported from the nut 62, but permitted to rotate with respect to it so that it may rotate instead with the wedge ring. Thus, another split ring is received between the inner surface of the wedge ring and the outer surface of the nut which releasably supports the wedge ring from the nut. When the nut is in the raised position of FIGS. 1 and 8, the wedge ring is also raised to permit the split ring 60 to assume a radially contracted position in which teeth 65 thereabout are spaced from the bore of the housing to permit the seal assembly to be lowered into the position of FIG. 1. However, upon lowering of the wedge ring with the nut in response to actuation of the tool T, the split ring 60 is forced downwardly and outwardly to cause the teeth 65 to engage in the grooves 23 in the bore of the housing and thus lock the expander ring downwardly so as to hold the first and second seal rings in expanded sealing positions. As shown by a comparison of FIGS. 1 and 2, lowering of the wedge ring to expand the split ring 60 will cause the lower end of the wedge ring to engage the upper end of the expanding ring.

The nut is caused to move downwardly to its upward position to its lower position by rotation by the tool T upon which the seal assembly has been lowered. For this purpose, the outer side of the nut has J slots 70A formed therein, and a downwardly lug 72 on the tool is adapted to move downwardly into and upwardly out of J slot in response to rotation and vertical movement of the tool. Obviously, when the lug is engaged in the lug slot and rotated to a position beneath the lower end of the J slot, the seal assembly is supported from the tool.

To summarize then, rotation of the tool T will cause the nut and thus the wedge to move downwardly from the position of FIG. 1 to the position of FIG. 2. This in turn causes the split ring 60 to move downwardly and outwardly, and thus the expanding ring to be lowered in order to energize the first and second seal rings and then move into locking engagement with the bore of the housing so as to hold the expander ring and thus the first and second seal rings in sealed positions. At this time, plastic packing may be injected through the port 50 and passageway means 52 into the grooves for the third and fourth seal rings for energizing them into sealing engagement with the pipe string.

As previously described, the seal assembly further includes a fifth seal ring 70 about the outer side of the seal assembly body beneath the second seal ring. As shown, the fifth seal ring is similar to each of the third and fourth seal rings in that it includes a body of elastomeric ring received within a recess 71 and split anti-extrusion rings 72 carried at the inner corners of the elastomeric body for purposes previously mentioned. As also previously described, passageway means 52 also connects with the recess 71 so that plastic packing injected through the port 50 and passageway means expands and thus energizes the seal ring 70, in this case outwardly into engagement with the bore of the housing beneath the second seal ring.

Figure 7:
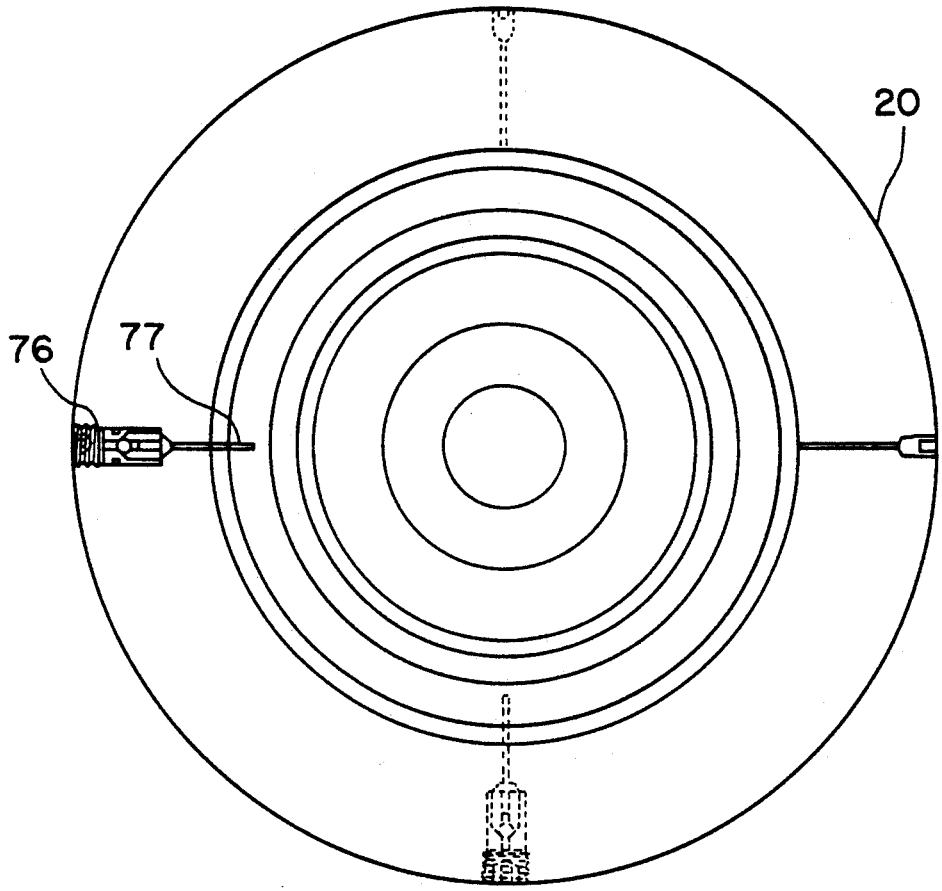
FIG. 7 is another cross-sectional view of the apparatus, but taken along broken line 7-7 of FIG. 2.

As shown in FIG. 7, another port 75 is formed in the housing to connect its outer diameter with its bore, and as rings, in the case of the port 50, has a one-way check valve 76 installed therein which permits flow only toward the bore of the housing. The inner end of this port 75 connects with the bore of the housing intermediate the second and fifth seal rings 30 and 70, and connects with a second passageway means 77 formed in the body connecting the outer side of the body of the housing intermediate the second and fifth seal rings with the inner side of the body intermediate the third and fourth seal rings 35 and 36. Hence, test fluid from a remote source, which may be at the head of the wellhead housing, may be introduced through the port 75 and passageway means 77 into the space between the inner side of the body and the pipe string intermediate the energized third and fourth strings so as to test the third and fourth seal rings.

As best shown in FIGS. 8 and 9, the first passageway means 52 includes means formed in the spacer ring to connect with the lower side of the first seal ring and the upper side of the second seal ring. This then permits plastic packing to be supplied to the first and second seal rings, as well as to the third fourth and fifth seal rings. This may be useful not only in causing the first and second seal rings to more tightly engage the bore of the housing, but also to reenergize the first and second seal rings in the event this is necessary.

Figure 4:
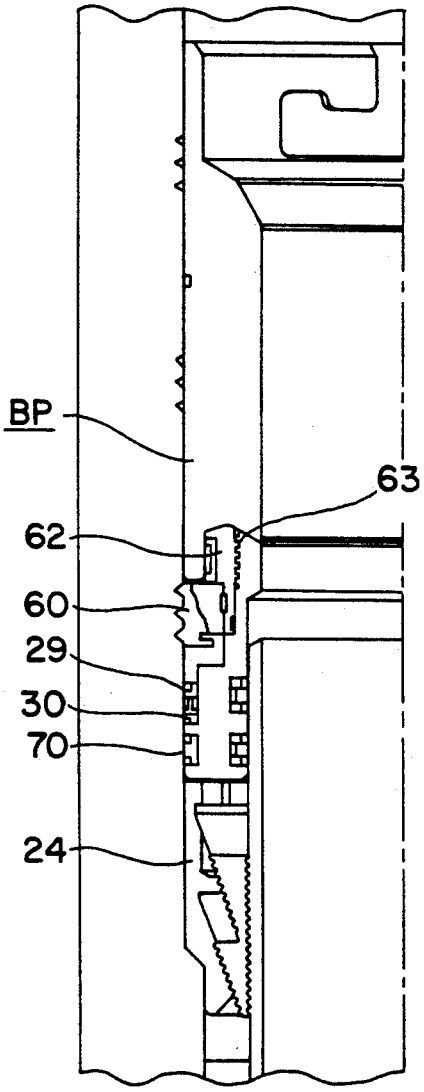
FIG. 4 is a view similar to FIG. 3, but upon completion of the testing of the third and fourth seal rings, and the subsequent lowering of a wear bushing onto the seal assembly prior to the drilling of a further hole within the wall bore.
Figure 5:
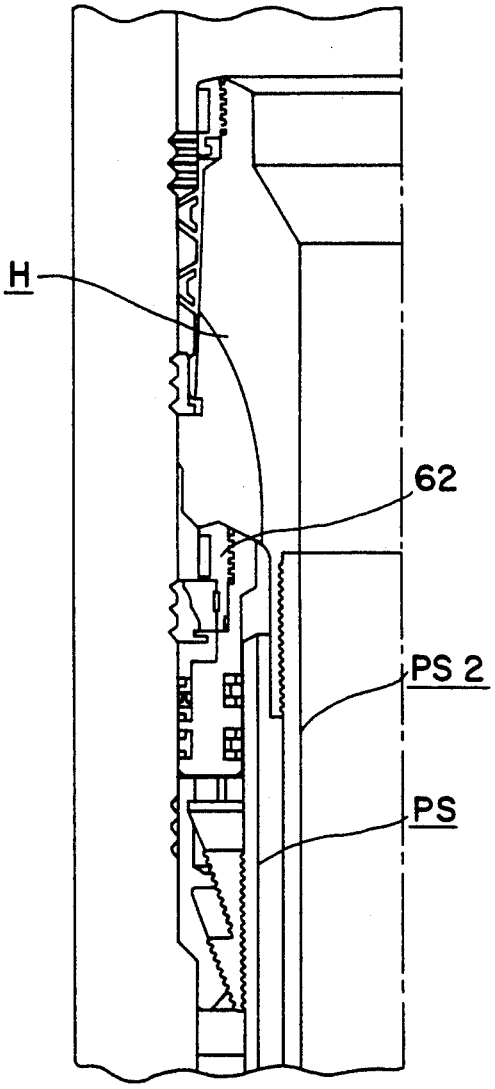
FIG. 5 is a view similar to FIG. 4, upon removal of the wear bushing following drilling of the further bore and lowering of a casing hanger onto the upper end of the seal assembly for suspending another pipe string within the pipe string suspended from the slip assembly.
Figure 6:
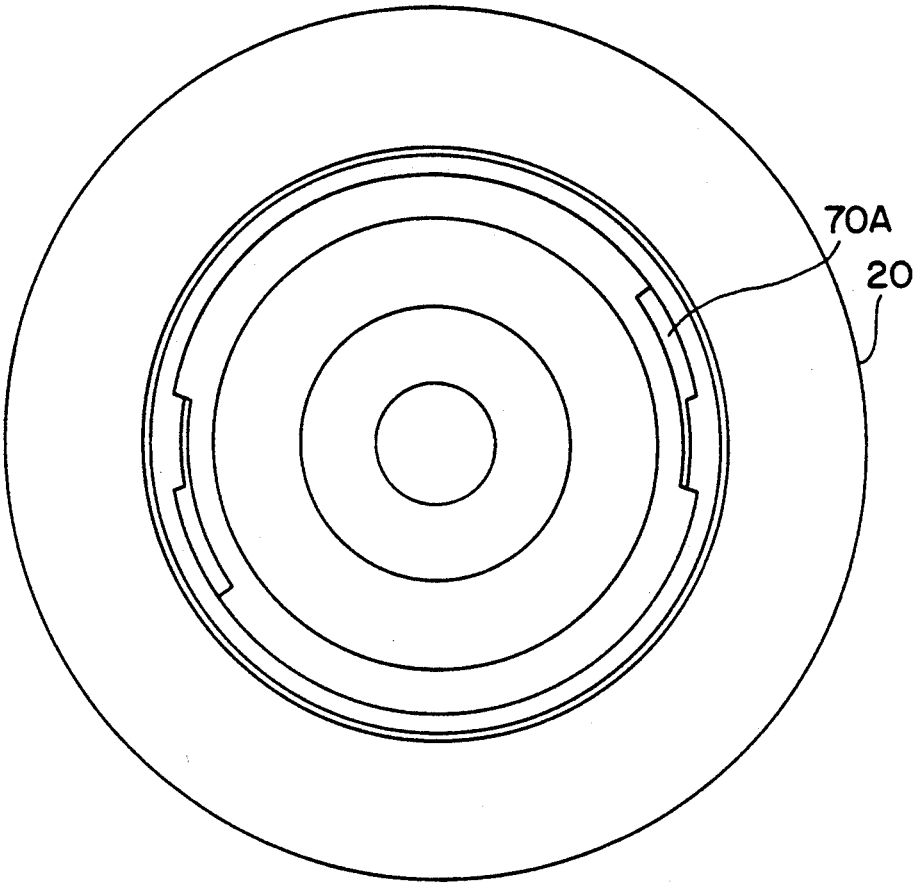
FIG. 6 is a cross-sectional view of the apparatus, as seen along broken line 6-6 of FIG. 1.

As previously described, this is particularly useful when, as is contemplated during the well completion operation, further equipment may be lowered onto the seal assembly. For example, upon energizing of the seal rings, the tool T may be removed and replaced by a bore protector BP which, as shown in FIG. 4, lands on the upper end of the seal assembly. Then, upon drilling of the further bore hole within the well, the bore protector would be replaced by another hanger H for suspending another pipe string PS 2 within the pipe string PS. In both cases, the weight of the further equipment would be supported by the upper end of the seal assembly. That is, the equipment would land directly on either or both of the upper end of the nut 62 and the adjacent inner side of the body of the seal assembly with which the nut is engaged. In either case, that load is transmitted directly to the body of the seal assembly, and thus to the hanger or other means from which it is in turn suspended in the wellhead housing.

As also previously described, the apparatus including the seal assembly enables the seals of the seal assembly to be energized and/or reenergized, as well as tested, from a remote source, and thus without the need for fluid lines or the like which would otherwise be required due to installation to the further equipment above the seal assembly.

As previously described, in the wellhead apparatus of FIG. 10, pipe string PS is suspended from a mandrel-type hanger 80 connected to its upper end and supported on pins 22A forming a seat in the bore 21 of housing 20. The seal assembly 27 is in turn landed on a shoulder 81 about a reduced diameter outer wall 82 of the hanger to seal between it and the bore. As shown, the seal assembly 27 has been caused to seal with respect to the bore and outer wall of the mandrel, and to be locked down in its landed position, as above described in connection with FIGS. 1 to 9.

As also shown in FIG. 10, an inner pipe string IPS has been lowered into pipe string PS, and another head 83 installed on the upper end of housing 20 is sealed about the upper reduced end of the mandrel hanger, thus closing access to the seal assembly other than through the ports in the housing.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Wellhead apparatus, which comprises a housing having a bore therethrough and a port opening to the bore and valve means in the port permitting flow only toward the bore, means for suspending a pipe string within the bore of the housing, an assembly for closing an annular space between the bore and an outer wall of either the suspended pipe string or the means by which it is suspended, and a tool for lowering the assembly into landed position, said assembly including an annular body having first and second seal rings carried about its outer side for sealing with the bore above and below the opening of the port thereto and a third seal ring carried on its inner side for sealing with the outer wall, means responsive to actuation of the tool, following landing of the assembly, for energizing the first and second seal rings into sealing engagement with the bore, and means including passageway means in the body connecting with its outer side between the first and second seal rings so that, when the first and second seal rings are energized, a medium may be supplied through the port and passageway means to the third seal ring for energizing it into sealing engagement with the outer wall.

2. Apparatus as described in claim 1, including a spacer ring carried about the body intermediate the first and second seal rings and having passageway means connecting the port and passageway means in the body, and wherein said means for energizing the first and second seal rings comprises means on the body which is responsive to vertical movement with respect to the body for expanding the first and second seal rings into sealing engagement with the bore, and means on the body releasably connectible to the tool and responsive to actuation of the tool for so moving the expanding means and then locking said expanding means against movement in the opposite vertical direction in order to hold the first and second seal rings in sealing engagement with the bore.

3. Apparatus as described in claim 2, wherein the expanding means comprises a ring surrounding the body above the first and second seal rings, and the moving and locking means comprises locking means supported by the expanding means for movement downwardly and outwardly into locking engagement with the bore, and means connected to the body for forcing said locking means downwardly and outwardly in response to actuation of the tool.

4. Apparatus as described in claim 3, wherein the expanding ring is lowered into engagement with the body and the locking and forcing means are lowered into engagement with the expanding means whereby the load of equipment lowered onto the assembly, following disconnection and removal of the tool therefrom, is transmitted to the body.

5. Apparatus as described in claim 4, wherein said forcing means includes a nut threadedly connected to the body, and the tool is releasably connected to the nut for transmitting rotation thereto in order to lower the nut in response to rotation of the tool.

6. Apparatus as described in claim 1, including a fourth seal ring carried on the inner side of the body for sealing with the wall below the third seal ring, and wherein said passageway means in the body includes means through which the medium may also be supplied to the fourth seal ring in order to energize it into sealing engagement with the outer wall.

7. Apparatus as described in claim 6, including a fifth seal ring carried about the outer side of the body for sealing with the bore below the second seal ring, and wherein said passageway means in the body includes means through which the medium may be supplied to the fifth seal ring in order to energize it into sealing engagement with the bore, said housing also has a second port opening to the bore intermediate the second and the fifth seal rings and valve means in the second port permitting flow only toward the bore, and the body also has second passageway means therein connecting its outer side intermediate the second seal ring and the fifth seal ring with the inner side of the body intermediate the third and fourth seal rings, whereby fluid may be introduced through the second port and second passageway means to test the third and fourth seal rings.

8. Apparatus as described in claim 1, wherein said connecting means also includes passageway means through which the medium may be supplied to the first and second seal rings in order to further energize them into sealing engagement with the bore.

9. Wellhead apparatus, which comprises a housing having a bore therethrough and a port through which a fluid medium may be supplied to the bore, means for suspending a pipe string within the bore of the housing, an assembly lowerable into landed position in the bore for closing an annular space between the bore and an outer wall of either the suspended pipe string or the means by which it is suspended, and including an annular body having first and second seal rings carried about its outer side for sealing with the bore above and below the opening of the port thereto and a third seal ring carried on its inner side for sealing with the outer wall, and means including passageway means in the body connecting with its outer side between the first and second seal rings so that the fluid medium may be supplied from the port to the passageway means to the third seal ring for energizing it into sealing engagement with the outer wall.

10. Apparatus as described in claim 9, including a fourth seal ring carried on the inner side of the body for sealing with the wall below the third seal ring, and wherein said passageway means in the body includes means through which the medium may also be supplied to the fourth seal ring in order to energize it into sealing engagement with the outer wall.

11. Apparatus as described in claim 10, including a fifth seal ring carried about the outer side of the body for sealing with the bore below the second seal ring, and wherein said housing also has a second port through which a test fluid may be supplied to the bore intermediate the second and the fifth seal rings, and the body also has second passageway means therein connecting its outer side intermediate the second seal ring and the fifth seal ring with the inner side of the body intermediate the third and fourth seal rings, whereby test fluid may be introduced through the second port and second passageway means to test the third and fourth seal rings.

* * * * *